United States Patent [19]

Ito et al.

[11] 3,993,252

[45] Nov. 23, 1976

[54] METHOD AND APPARATUS FOR RECOVERING CRUDE PULP STOCK FROM MUNICIPAL WASTE

[75] Inventors: Kanichi Ito, Yokohama; Yoshio Hirayama, Kamakura, both of Japan

[73] Assignee: Ebara Manufacturing Co., Ltd., Tokyo, Japan

[22] Filed: July 16, 1975

[21] Appl. No.: 596,526

Related U.S. Application Data

[63] Continuation-in-part of Ser. No. 464,219, April 25, 1974, abandoned.

[30] Foreign Application Priority Data

May 1, 1973 Japan ..... 48-49339

[52] U.S. Cl. ..... 241/21; 241/24; 241/29; 241/43; 241/163; 241/DIG. 38

[51] Int. Cl.[2] ..... B02C 23/38

[58] Field of Search ..... 241/21, 24, 27, 29, 241/43, 45, 73, 74, 79.3, 85, 91, 163

[56] References Cited

UNITED STATES PATENTS

| | | | |
|---|---|---|---|
| 1,837,782 | 12/1931 | Little | 241/85 |
| 2,423,994 | 7/1947 | Petersen | 241/91 X |
| 2,846,153 | 8/1958 | Krogh | 241/91 X |

*Primary Examiner*—Granville Y. Custer, Jr.
*Attorney, Agent, or Firm*—James E. Nilles

[57] ABSTRACT

Crude pulp stock is recovered from municipal waste by selectively pulverizing garbage (food waste) in the waste; removing the pulverized garbage; thence, moistening the rest of the waste so as to selectively weaken the materials, such as waste paper, usable as crude pulp stock; and taking out the pulverized crude pulp stock.

3 Claims, 3 Drawing Figures

METHOD AND APPARATUS FOR RECOVERING CRUDE PULP STOCK FROM MUNICIPAL WASTE

CROSS REFERENCE TO RELATED APPLICATION

This application is a continuation-in-part of our application, Ser. No. 464,219 filed on Apr. 25, 1974, now abandoned.

FIELD OF THE INVENTION

The present invention relates to a system for recovering usable material from waste and, more specifically relates to a method and apparatus for recovering crude pulp stock from municipal waste.

BACKGROUND OF THE INVENTION

The proportion of waste paper or the like included in municipal waste is tending to become higher these days. Heretofore, the recovery of such waste paper as crude pulp stock has been effected by utilization of a hydrapulper such as, for example, shown in U.S. Pat. No. 3,549,092, in the name of Joseph Baxter, Jr., issued on Dec. 22, 1970, wherein all the municipal waste is agitated in an aqueous medium or water so as to make a slurry.

However, if such a system is employed where waste includes a relatively high percentage of garbage, the discharge will create a problem, since the BOD (Biochemical Oxygen Demand) value of an aqueous medium or water used as a medium for separating crude pulp stock becomes high and, therefore, post-treatment of the used water is necessary to avoid pollution or nuisance. Further, in the case the ratio of garbage to paper or the like in municipal waste is relatively high, the recovery rate of crude pulp stock from the waste by the conventional process referred to above is expected to become lower, since the amount of crude pulp stock adhering to materials to be separated from pulp stock will increase in proportion to the increase of the ratio of garbage to paper or the like in the waste. In addition to the above drawbacks, a complicated dewatering apparatus is required in order to directly incinerate or heat-decompose the separately removed materials as they are extracted from the slurry because the removed materials contain a large quantity of water and, thus, cause great heat-loss in the process of incineration or heat-decomposition. Also, such a dewatering apparatus as above or other devices will become necessary when the recovered crude pulp stock is transported to a paper mill company.

SUMMARY OF THE INVENTION

Accordingly, it is an object of the present invention to provide a method and an apparatus for recovering usable materials from municipal waste by which the drawbacks discussed above are eliminated.

Another object of the present invention is to provide a recovery system which performs the pulverizing and selecting operations with the materials in a dry state as much as possible, and obviates the necessity of using a dewatering device and the secondary pollution caused thereby.

Still another object of the present invention is to improve the recovery rate in the system by pre-separating garbage or the like from the waste and removing as much of the garbage as possible before treating the portion containing reusable materials.

It is also proposed by the present invention to simplify the post-treatment of the waste after crude pulp is recovered therefrom, to reduce the cost of installation and operation of the system and to eliminate the chance of producing environmental pollution.

According to the present invention, municipal waste is introduced into a cylindrical pulverizer which comprises a rotatable cylindrical means and a size-reducing means adapted to rotate inside the screen to create a relative rotation between the screen means and the reducing means.

Upon operation of the pulverizer, relatively soft constituents of the waste mainly consisting of garbage are selectively pulverized first and extracted from the waste. Thereafter, the rest of the waste is moistened and reintroduced into a second part of the cylindrical pulverizer wherein the materials primarily comprising waste paper or the like and tending to be weakened in strength by absorption of moisture are selectively pulverized in damp state rather than in slurry state and separately extracted as crude pulp stock.

The other objects and advantages of the present invention will be apparent to those skilled in the art by the description which follows.

BRIEF DESCRIPTION OF THE DRAWINGS

Reference is now made to the drawings wherein like reference numerals designate like parts and wherein.

DESCRIPTION OF THE PREFERRED EMBODIMENTS

Figure 1:
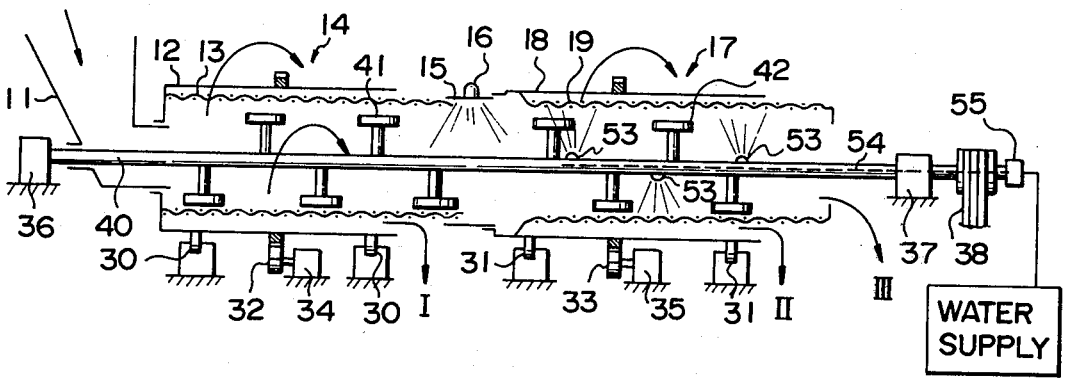
FIG. 1 shows a schematic illustration, in section, of a preferred embodiment of the present invention.

Referring to FIG. 1, municipal waste is charged into a hopper 11 which communicates with a first cylindrical pulverizer 14 comprising an outer cylinder 12, an inner cylindrical screen 13 and size reducing blades 41 which are constructed so as to be rotatable independently of said inner cylindrical screen. The size reducing blades 41 are mounted on a shaft 40 which is supported by suitable bearing means 36 and 37 at opposite ends of the shaft and is adapted to be driven by a driving means 38. The outer cylinder 12 and inner cylindrical screen 13 are rotatably supported by rollers 30 and driven by a driving motor 34 through a driving gear 32 so as to be rotated as a unit at a speed different from that of the size reducing blades 41.

Upon operation of the pulverizer with the waste therein, soft constituents I of the waste, mainly constituted of garbage (food waste), are selectively pulverized by agitation effect mainly due to relative rotation between the size reducing blades 41 and the cylindrical screen 13. The materials thus pulverized as well as sand and small grains in the waste pass through the inner cylindrical screen 13 so as to be separately disposed within the outer cylinder 12.

The rest of the waste material is fed to a stationary cylinder 15 wherein water is sprayed on the materials through a spray nozzle 16 and, thence, into a second cylindrical pulverizer 17. The second cylindrical pulverizer 17 is similar to the first pulverizer 14 and also comprises an outer cylinder 18, a cylindrical screen 19 and size reducing blades 42 mounted on the rotatable shaft 40. The outer cylinder 18 and cylindrical screen 19 are also rotatably supported by rollers 31 and driven by a driving motor 35 through a driving gear 33.

The pulverizer 17, similarly as in the pulverizer 14, selectively pulverizes constituents II of the waste fed thereinto, which primarily contain paper or the like and thus tend to lose strength by absorption of moisture, under agitating effect mainly caused by relative rotation between size reducing blades 42 and the cylindrical screen 19.

The pulverized materials II pass through the inner cylindrical screen 19 so as to be separately disposed within the outer cylinder 18.

The constituents II of the waste thus extracted above are regarded as crude pulp stock and contain approximately 60% water and it is found that no further dewatering is necessary for transportation.

Figure 2:
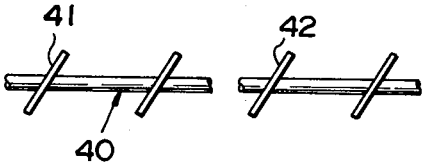
FIG. 2 shows size reducing blades in their twisted condition.

The size reducing blades 41 and 42 may be twisted as shown in FIG. 2 so as to facilitate advancement of the waste in the first and second pulverizers 14 and 17. Also, in stead of the water spray nozzle 16 a water nozzle means 53 may be provided on the shaft and in such case, the shaft 40 is provided with a hole 54 or made of a hollow tube to which a water supply source is coupled through a rotary joint 55 fixed to the terminal end of shaft 40 as schematically shown in FIG. 1.

The balance of the materials III comprise combustible constituents such as plastics, wood and rubber and noncombustible constituents such as metals. Some of the materials III may be separately and selectively taken out for further usage by employing necessary steps known in the art.

According to the present invention, water is added to municipal waste from which garbage has been selectively removed and the waste paper and the like is the waste which tend to lose strength upon absorption of moisture are selectively pulverized and separately extracted from the rest.

Figure 3:
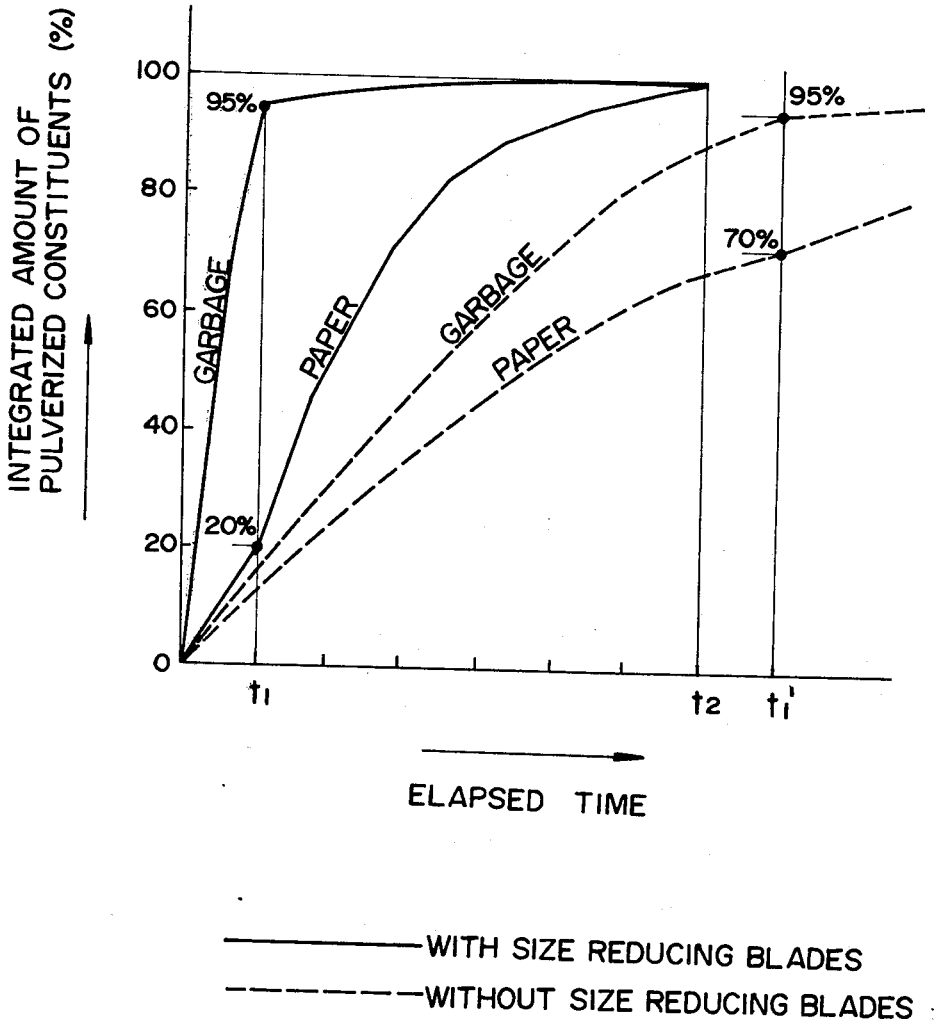
FIG. 3 is a diagram illustrating the effect of size reducing blades compared to that of the apparatus having no size reducing blade.

In order to explain the basis of the present invention as to how the difference in constituents effects to achieve selective pulverization, the diagram of FIG. 3 is touched upon. This diagram shows the result of a test made to measure the amount each of garbage discharged and waste paper or crude pulp stock discharged in relative to the lapsed time. The solid lines are the result obtained by a batch type test machine provided with a rotatable screen and rotatable size reducing blades within the screen such as shown in FIG. 1, which are adapted to rotate at a speed different from that of the surrounding rotatable screen. As indicated, the ordinate shows an integrated pulverized amount passed through the screen and the abscissa shows the elapsed time by using the test machine in which the sample waste is charged. The solid lines correspond to the typical test results. According to the curves illustrated, it is clear that, at the elapsed time $t_1$ when approximately 95% of total garbage has been discharged, only approx. 20% of total waste paper has been discharged together with the discharged garbage. At this time, if the rest of the waste remaining in the test machine is slightly moistened, the discharge rate of waste paper remarkably increases and at the elapsed time $t_2$, almost all of the waste paper is discharged. The great difference in the respective discharged amounts indicated in FIG. 3 indirectly proves the difference in physical property or strength between garbage and waste paper. The present invention, in other words, may be said as one positively utilizing this difference.

Thus, in determining the respective longitudinal lengths of the pulverizers 14 and 18, the above test result may be advantageously taken into account. For instance, the respective lengths of the 1st and 2nd pulverizers are preferably determined so as to provide appropriate dwelling periods corresponding to $t_1$ and $t_2$ to the pulverizers 14 and 17, respectively. If these lengths are so arranged as above, the discharged materials I at the first pulverizer 14 will contain approx. 95% of total garbage in the charged refuse or waste and approx. 20% of total waste paper in the charged waste whereby the remaining waste to be further processed within the second pulverizer will contain only approx. 5% of total garbage and approx. up to 80% of total waste paper. The moistening above after the first processing stage is over, speeds up the discharge of the waste paper and produces the result of obtaining crude pulp stock of high quality and strength.

The dotted lines in FIG. 3 is the result of another test conducted by the same test machine from which the size reducing blades were removed. Thus, the comparison between the solid lines and the dotted lines indicates, in fact, the effect of the size reducing blades. The dotted lines are also the typical results. From the dotted lines of FIG. 3, it is clear that period $t'_1$ necessary for discharging 95% of total garbage by the test machine having no size reducing blade reaches to approx. 8 times to period $t_1$ above and further approx. 70% of total waste paper is also discharged during this period $t'_1$. This means that, if the apparatus such as shown in FIG. 1 is not provided with the size reducing blades, its separating capacity will be remarkably reduced and waste paper concentration in constituents II of the waste may be held below approx. 30% of total waste paper thereby greatly lowering the recovery rate of crude pulp stock. Further, in case of the apparatus having no size reducing blade, the pulverization of charged waste relies mainly on agitation by the bottles and/or cans contained within the waste. However, the ratio of the bottles or cans contained in the waste to the rest is not constant and, thus, the pulverizing effect achieved by these constituents is not steady and its value depends on the proportion of bottles or cans making up the constituents. In other words, the processing time required for a certain amount of the charged waste is not constant and varies since the ratio of the cans or bottles in the waste to the rest is not constant. Therefore, even though the respective lengths of first and second cylindrical pulverizers having no size reducing blade are appropriately determined to the certain constituents of the waste, the ratio of garbage contained in the constituents II to the rest is also not constant whereby it is difficult to maintain the purity of recovered crude pulp stock at a certain level. Thus, from the foregoing description, it will be readily appreciated that the size reducing blades of the present invention play an important part in recovering crude pulp stock with respect to the capacity of the pulverizer and quality of the crude pulp stock recovered.

Therefore, in contrast to the process of the prior art wherein all the municipal waste is agitated in water so as to make a slurry and crude pulp stock is recovered from the slurry, post-treatment of water used as a separating medium and given a high BOD value becomes unnecessary in the present invention. Thus, the system of the present invention provides an economical way to handle municipal waste and avoids secondary environmental pollution. When crude pulp stock II is refined by a well known used paper recovering process, the recovery rate and the grade of the recovered quality will be remarkably increased since soft constituents, such as garbage, sand and small pebbles or grains have been previously excluded from the waste and, thus, the quantity of the materials to be removed for obtaining crude pulp stock is greatly reduced and accordingly the amount of reusable materials taken away together with the materials to be separately removed is also reduced. Further, garbage removed from waste may be utilized by means of compost processing or the like and, in such case, there is no necessity for dewatering the garbage. Also, the respective ratios of water included in the materials II and III are relatively low and therefore dewatering process is unnecessary for incinerating or heat-decompositioning these materials thereby making the post-treatment simple and economical. In addition to the above, there is also no necessity for dewatering when crude pulp stock II is transported.

As explained in detail above, it is evident that the present invention has remarkable advantages in that post-treatment of water usually required becomes substantially unnecessary, continuous operation of the system is possible and economical operation for treating municipal waste is achieved in addition to recovery of useful materials.

While the present invention has been explained in detail referring to the preferred embodiments, it should be noted that the present invention will be readily modified by those skilled in the art within the scope of the invention defined in the appended claims.

What is claimed is:

1. A method for recovering crude pulp stock from municipal waste containing food waste and crude pulp stock, the method comprising the steps of:

beating and agitating said municipal waste without adding water and thereby pulverizing said food waste;

removing the pulverized food waste;

slightly moistening the remaining municipal waste;

beating and agitating the moistened remaining municipal waste thereby pulverizing said crude pulp stock; and removing the pulverized crude pulp stock.

2. An apparatus for recovering crude pulp stock from municipal waste including soft constituents, the apparatus comprising:

a hopper means for receiving said municipal waste;

a first rotary pulverizer communicating with said hopper at one end of said pulverizer for receiving municipal waste from said hopper, said first pulverizer including means for pulverizing said soft constituents and including an opening for discharging the soft constituents pulverized in said first cylinder;

a second rotary pulverizer communicating with said first pulverizer for receiving municipal waste including crude pulp stock from said first pulverizer, said second pulverizer including means for agitating and pulverizing said crude pulp stock and having an opening for discharging the pulverized crude pulp stock from said second pulverizer; and a spray means disposed in said second pulverizer to moisten the municipal waste in the second pulverizer.

3. An apparatus for recovering crude pulp stock from municipal waste which includes food waste and crude pulp stock, the apparatus comprising:

a hopper means for receiving said municipal waste;

a first pulverizer including a first rotatable cylindrical screen communicating with said hopper means for receiving municipal waste from said hopper, means for rotating said first cylindrical screen, means for agitating and pulverizing the food waste whereby the food waste can pass through said first cylindrical screen, said means for agitating and pulverizing the food waste including size reducing blades rotatably supported within said first cylindrical screen and means for rotating said blades at a speed different from the speed of rotation of said first cylindrical screen, and a first opening for discharging said pulverized food waste;

a second pulverizer including a second cylindrical screen communicating with said first cylindrical screen for receiving municipal waste from said first pulverizer, means for rotating said second cylindrical screen, means for agitating and pulverizing the crude pulp stock in said remaining municipal waste whereby the pulverized crude pulp stock can pass through said second cylindrical screen, said means for agitating and pulverizing the crude pulp stock including size reducing blades rotatably supported within said second cylindrical screen and means for rotating said blades at a speed different from the speed of rotation of said second cylindrical screen; and a second opening for discharging the portion of waste selectively pulverized in said second cylindrical screen; and a spray means to moisten the waste in said second cylindrical screen.

* * * * *